US005588278A

United States Patent [19]

Wynn et al.

[11] Patent Number: 5,588,278

[45] Date of Patent: Dec. 31, 1996

[54] BROCCOLI BANDING MACHINE

[75] Inventors: Ed Wynn, Monterey; Javier Diaz-Infante, Salinas; Peter deGroot, Carmel, all of Calif.

[73] Assignee: Dole Fresh Vegetables Co., Salinas, Calif.

[21] Appl. No.: 495,235

[22] Filed: Jun. 27, 1995

[51] Int. Cl.[6] ..... B65B 53/00; B65B 11/00

[52] U.S. Cl. ..... 53/399; 53/585; 53/441; 53/556; 53/390; 100/9

[58] Field of Search ..... 100/9; 53/74, 399, 53/585, 556, 441, 390, 291

[56] References Cited

U.S. PATENT DOCUMENTS

| | | | |
|---|---|---|---|
| 3,045,403 | 7/1962 | Mitchell | 53/74 |
| 3,563,002 | 2/1971 | Givin | 53/390 |
| 3,964,380 | 6/1976 | Meyer et al. | 100/9 |
| 4,217,744 | 8/1980 | Mizutani | 53/74 X |
| 4,480,536 | 11/1984 | Burns | 53/585 X |
| 4,570,415 | 2/1986 | Centeno | 53/585 X |

*Primary Examiner*—Linda Johnson
*Attorney, Agent, or Firm*—Townsend and Townsend and Crew

[57] ABSTRACT

A broccoli banding machine having an electric DC motor drive actuated by an interrupted optical beam is disclosed. The banding machine includes a plate with a central aperture defining a depending cylinder. The depending cone has a light beam looking across the cylinder which when interrupted keeps arms having band engaging fingers in the band expanded position. Both arms and fingers are mounted above the supporting plate where access and view of arms by the banding and packing worker is provided at all times. Upon gathering broccoli to a bouquet with both hands, the worker places the stalks of the gathered bouquet into the cylinder, interrupting the light beam. Upon such interruption, the arms at the band engaging fingers are cycled into the bunched stalks, the contracted band released to the stalk, the bouquet at the stalks removed from the vicinity of the fingers, and a new rubber band placed upon the centrally disposed fingers. Thereafter, and at the end of a timed cycle, the arms with the band engaging fingers expand the newly installed band, and the cycle repeated. An improved drive is present for the arms in the form of a DC electric motor, which intermittently rotates over approximate 180° intervals at a set and adjustable rate. There results an improved banding operation which ergogenically cooperates with the entirety of the broccoli bunching, banding and packing processes.

8 Claims, 5 Drawing Sheets

BROCCOLI BANDING MACHINE

This invention relates to a broccoli banding machine of the type utilized in the field to place a rubber band around the stems of a bouquet of broccoli. More particularly, a bander having controlled speed arm action is combined with an optical sensor to ergogenically assist the banding and packing process of harvested broccoli.

BACKGROUND OF THE INVENTION

Broccoli harvest and packing is preferably completed to the shipping carton in the field. In such harvest and packing, the individual flowers and stems are cut and laid on a tray. Thereafter, the groups of flowers and stems are gathered and banded at the stems into a bouquet. The banded bouquet is then carefully packed within a produce transport carton for shipping. The carton is thereafter removed from the field, refrigerated and shipped.

In the field, plants are typically cut by one worker and thereafter placed upon a sorting tray. A second worker removes the plants from the sorting tray, matches the flowers and stems into a bouquet, bands the stems as matched, and thereafter packs the bouquet to the transporting carton. Naturally, if a broccoli banding machine is to be used, it must cooperate with the second worker engaged in the bunching or bouquet process to ease the labor burden; in other words, it must ergogenically cooperate with the bunching and packing process.

An exemplary banding machine of the prior art is disclosed in Parry et al. U.S. Pat. No. 4,470,241 issued Sep. 11, 1984 and entitled Apparatus for Bunching, Trimming and Banding Vegetables. This device includes a flat supporting plate forming a centering opening. Broccoli to be banded is gathered in a bouquet and placed within and supported by the centering opening.

Below the centering opening, a plurality of—and preferably four—pivotally mounted spring biased arms with upwardly extending fingers are disposed for movement within a plane parallel to but below the flat supporting plate. These arms move at their fingers into and out of a central juxtaposition of the fingers with respect to the centering opening. When the fingers of the arms are juxtaposed centrally of the centering opening, a rubber band is placed upon the fingers. When the fingers of the arms are moved away from their disposition centrally of the centering opening, the rubber band is stretched in an open stem receiving disposition. With the rubber band stretched in the open stem receiving disposition, the stem is inserted and the arms returned to their central disposition. In returning to the central disposition, the arms move inward until the arms and contracting rubber band contact the bunched stalks of the bouquet. The bouquet is then withdrawn upwardly, removing the rubber band from the fingers and leaving the rubber band attached to the stalks. The arms under their spring bias move inwardly, and a new rubber band is added, and the cycle repeated.

Ergogenic cooperation has not been fully realized by the prior art. Typically, the prior art has utilized pneumatic cylinders, has banding fingers that are at least partially covered or concealed, and requires banding to be initiated by a separate button or control. Each of these prior art requirements detracts from the efficiency of the packing process.

The use of pneumatic actuating cylinders is not without difficulty. Specifically, rates of movement are difficult to control precisely—and frequently are too fast. For example, many rubber bands expand within their elastic limit at rates that are both temperature dependent and rate of expansion dependent. Where these rates of expansion are exceeded, breaking of the rubber bands occurs. Where the temperatures are cold and the bands are rapidly expanded, the tendency of rubber bands to snap because of such rapid expansion is aggravated. It should be noted that this is more than a costly inconvenience; such bands snap with considerable force and can constitute a safety hazard, especially to the eyes of nearby workers.

Air is compressible—therefore excessive friction or other blockage in the linkage can cause momentary stoppage until air pressure increases and overcomes the friction. At this point, the compressed air can be "explosive" inside the cylinder, causing rapid and potentially dangerous movement.

As a further difficulty, in the machine just described, the supporting plate extends over the band expanding arms. With this arrangement, some arm movement is not only out of the line of sight of the worker conducting the banding operation but additionally access to the arms—especially when the arms are in the band expanding disposition—is restricted. Where a band slips from the finger of a retracted and expanding arm, the machine must be cycled.

Finally, for each movement of the arms desired—moving to the band stretching disposition or moving to the central band installing and receiving position—a button must be depressed by the operator. This is not trivial. Broccoli bouquets are typically large enough so that to be properly held, both hands must be used to gather the stalks from the sorting tray and move the gathered stalks to the banding machine. Since both hands must be used for such movement, and the bouquet cannot be properly supported by one hand, the prior art has relied on the supporting plate overlying the arms and the central supporting hole for temporary support of the bouquet while banding is initiated. Further, and when it is desired to expand a rubber band after a band is placed on the fingers of the arm, a second and independent actuation of the banding machine must be made. While this sounds trivial, it must be remembered that the worker bunching and banding the broccoli into a bouquet is also packing the bouquets to a carton. Further, since this packing step constitutes the last time the broccoli will be handled until it arrives at its shipping destination, it must be done with care. Simply stated, manual machine actuation is a costly interruption which reduces productivity.

SUMMARY OF THE INVENTION

A broccoli banding machine having an electric DC motor drive actuated by an interrupted optical beam is disclosed. The banding machine includes a plate with a central aperture defining a depending cylinder. The depending cone has a light beam looking across the cylinder which when interrupted keeps arms having band engaging fingers in the band expanded position. Both arms and fingers are mounted above the supporting plate where access and view of arms by the banding and packing worker is provided at all times. Upon gathering broccoli to a bouquet with both hands, the worker places the stalks of the gathered bouquet into the cylinder, interrupting the light beam. Upon such interruption, the arms at the band engaging fingers are cycled into the bunched stalks, the contracted band released to the stalk, the bouquet at the stalks removed from the vicinity of the fingers, and a new rubber band placed upon the centrally disposed fingers. Thereafter, and at the end of a timed cycle, the arms with the band engaging fingers expand the newly installed band, and the cycle is repeated. An improved drive is present for the arms in the form of a DC electric motor, which intermittently rotates over approximate 180° intervals at a set and adjustable rate. There results an improved banding operation which ergogenically cooperates with the entirety of the broccoli bunching, banding and packing processes.

BRIEF DESCRIPTION OF THE DRAWINGS

FIG. 2B is a perspective detail of the stalks being removed from the vicinity of the band holding fingers with band being removed with the stalks and removed from the fingers;

FIG. 2C is a perspective detail of the worker placing a rubber band on the centrally moved fingers just before timed arm movement for expansion of the placed rubber band to the view of FIG. 1 for repeat of the cycle;

DESCRIPTION OF THE PREFERRED EMBODIMENT

Figure 1:
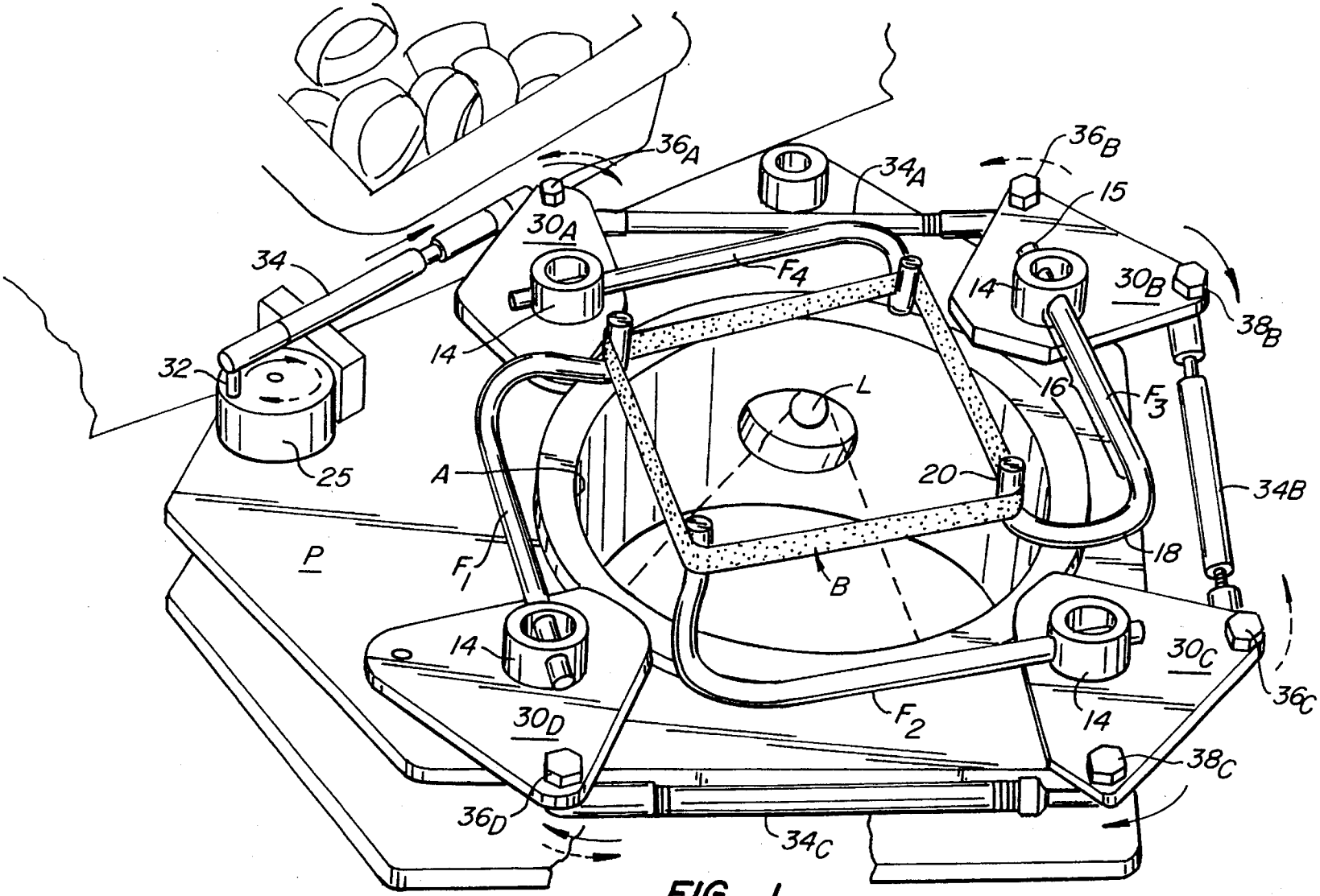
FIG. 1 is a perspective view of the apparatus of this invention illustrating the banding apparatus of this invention with the arms moved with their banding engaging fingers holding the band in the expanded position providing the view with a clear view of the arm actuating linkages utilized with the invention.
Figure 2C:
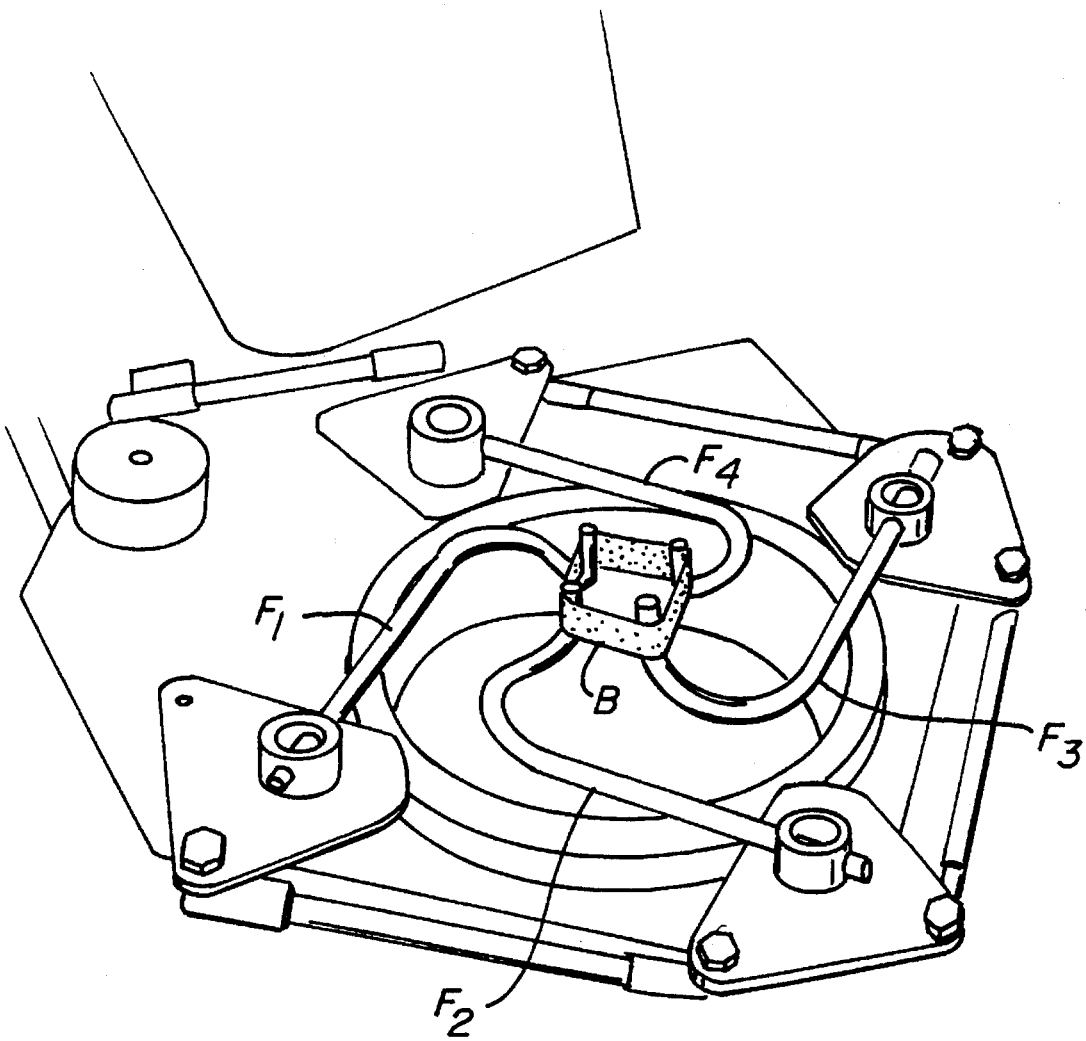
FIGS. 2A, 2B and 2C are a cartoon series illustrating respectively with, FIG. 2A showing the hand of a worker holding a bouquet of broccoli with the stems being placed within the bander cylinder to interrupt the light beam and initiate band contraction.
Figure 3:
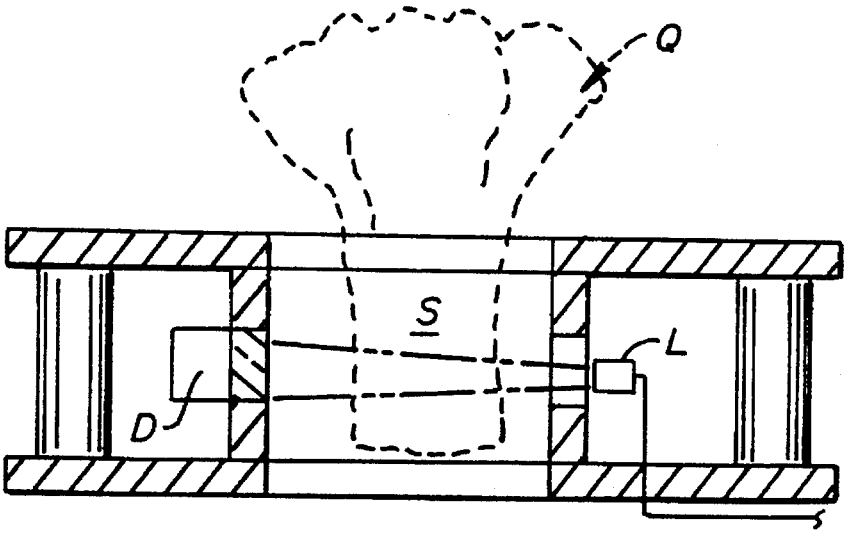
FIG. 3 is a detail of two proximity sensors about a central rotating and driving wheel for actuating the spring biased arms in their movement to and from band placement to bunched stalks.
Figure 2A:
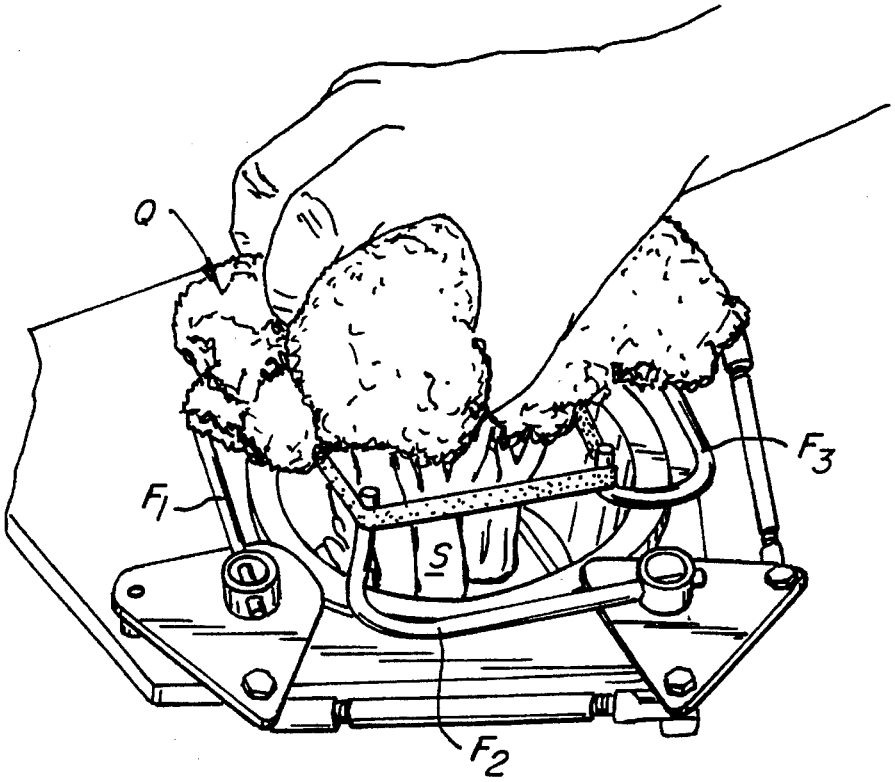

Referring to FIG. 1, plate P is illustrated having central aperture A. Supported on plate P are four pivotal arms $F_1$–$F_4$. These respective pivotal arms have the purpose of expanding and contracting rubber bands B as they are placed about bouquet of broccoli Q (not shown in FIG. 1; see FIGS. 2–4).

Pivotal arms $F_1$–$F_4$ each have substantially identical construction. Specifically, pivot cylinder 14 rotates relative to plate P. Pivot plate P is bored and receives end 15 of each arm. From end 15 each arm extends at shank 16 to arcuate portion 18, which arcuate portion ends at upwardly extending rubber band engaging end 20. Each arm is attached to and rotates with respective arm pivot plates $\mathbf{30}_A$–$\mathbf{30}_D$.

Drive of pivotal arms $F_1$–$F_4$ is easy to understand. Power for arm movement is provided through driving wheel 25. Driving wheel 25 rotates and has attached eccentric pin 32 connected to main rod link 34. Main rod link 34 reciprocates responsive to driving wheel 25 undergoing rotation. Main rod link 34 at its opposite end attaches to arm pivot plates $\mathbf{30}_A$ at attachment point $\mathbf{36}_A$. Thus, when driving wheel 25 rotates, arm pivot plate $\mathbf{30}_A$ likewise pivots causing pivotal arm $F_4$ to pivot. Such pivotal movement occurs between a first position wherein the arm is concentric to central aperture A and a second position where the arm is withdrawn around the periphery of central aperture A.

Appropriate linkage transfers the motion of pivotal arm $F_1$ to remaining pivotal arms $F_2$–$F_4$. Specifically, and through respective link arms $\mathbf{34}_A$–$\mathbf{34}_C$, link points $\mathbf{36}_A$–$\mathbf{36}_D$, second link points $\mathbf{38}_A$–$\mathbf{38}_C$, and rotation of arm pivot plates $\mathbf{30}_A$–$\mathbf{30}_D$, all of the respective pivotal arms $F_1$–$F_4$ move simultaneously to and from a concentric position towards and away from the center of central aperture A. As will be appreciated, respective link arms $\mathbf{34}_A$–$\mathbf{34}_C$ as well as main rod link 34 are all provided with appropriate adjustment.

Figure 5:
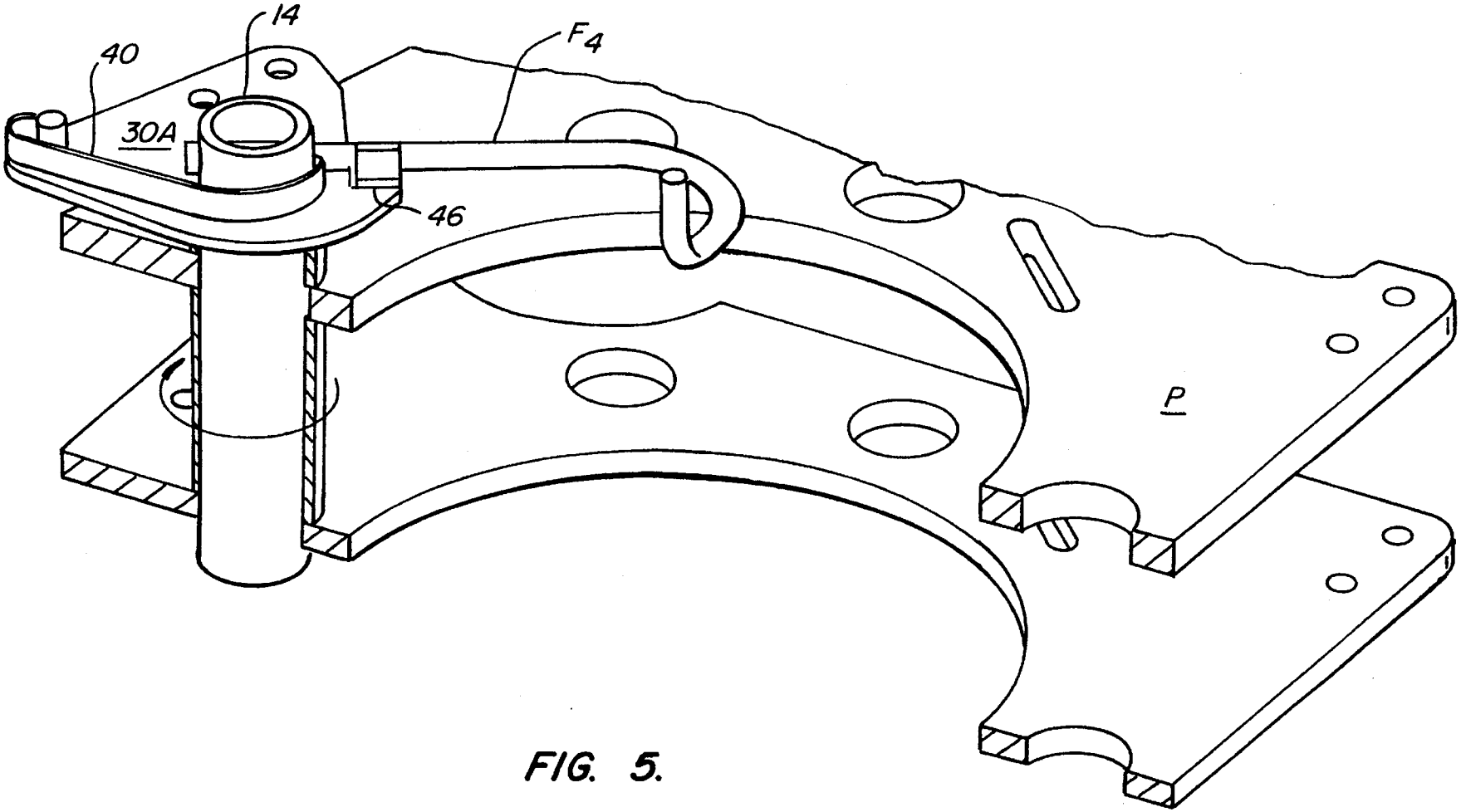

It is to be understood that pivotal arms $F_1$–$F_4$ are spring biased with respect to arm pivot plates $\mathbf{30}_A$–$\mathbf{30}_D$. Referring to FIG. 5, arm 14 is shown biased by rubber band 40 to the closed position. In such bias, pivot arm $F_4$ is biased against arm stop 46 on arm pivot plate $\mathbf{30}_A$. Naturally, driving of main rod link 34 over comes such bias to move pivot arm $F_4$ from center to expand band B. It will be understood that the remaining pivotal arms $F_1$–$F_3$ are of identical construction and actuation.

The function of these respective pivotal arms $F_1$–$F_4$ at upwardly extending rubber band engaging end 20 can be readily understood with reference to FIGS. 1–4. When the bander of this invention is ready to band bouquet of broccoli Q, pivotal arms $F_1$–$F_4$ are retracted with respect to central aperture A. In this retracted position, pivotal arms $F_1$–$F_4$ stretch rubber band B so that bouquet of broccoli Q may be received at stems S as illustrated in FIGS. 2A and 2B.

Figure 2B:
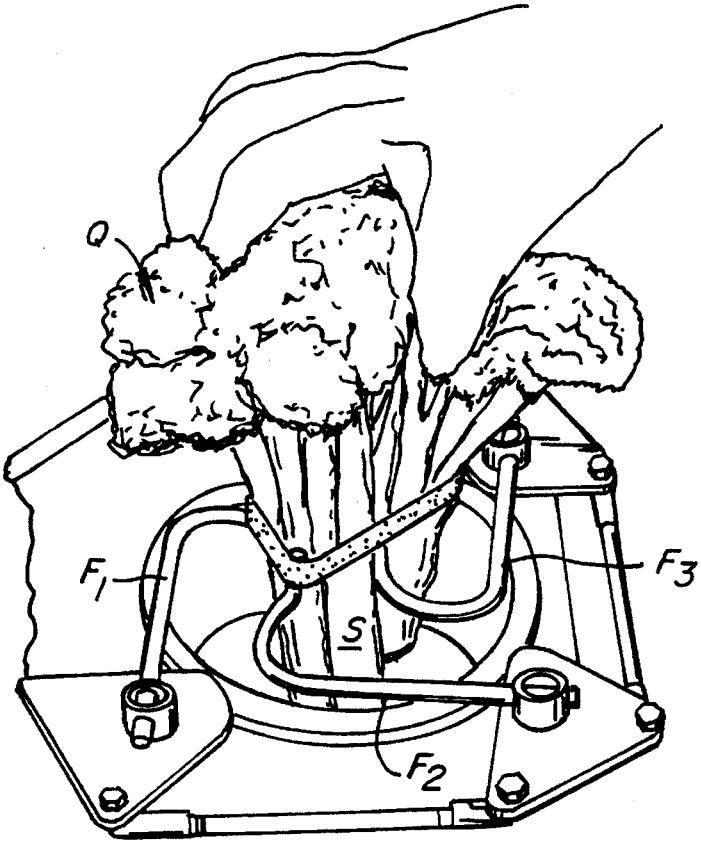

Thereafter, pivotal arms $F_1$–$F_4$ move to a central position, with stems S still inward of central aperture A as shown in FIG. 2B. Band B elastically contracts to stems of bouquet of broccoli Q. When bouquet of broccoli Q is removed, pivotal arms $F_1$–$F_4$ remain centrally disposed. It is at this time an un-stretched rubber band B is placed over pivotal arms $F_1$–$F_4$ at upwardly extending rubber band engaging end 20.

Finally, and after expiration of an appropriate time period, stretching of rubber band B occurs. The reader will understand that over the prior art it is the mechanism by which such movement of pivotal arms $F_1$–$F_4$ occurs as well as the rate and timing of movement of pivotal arms $F_1$–$F_4$ which form the novel subject matter of this invention.

Figure 4:
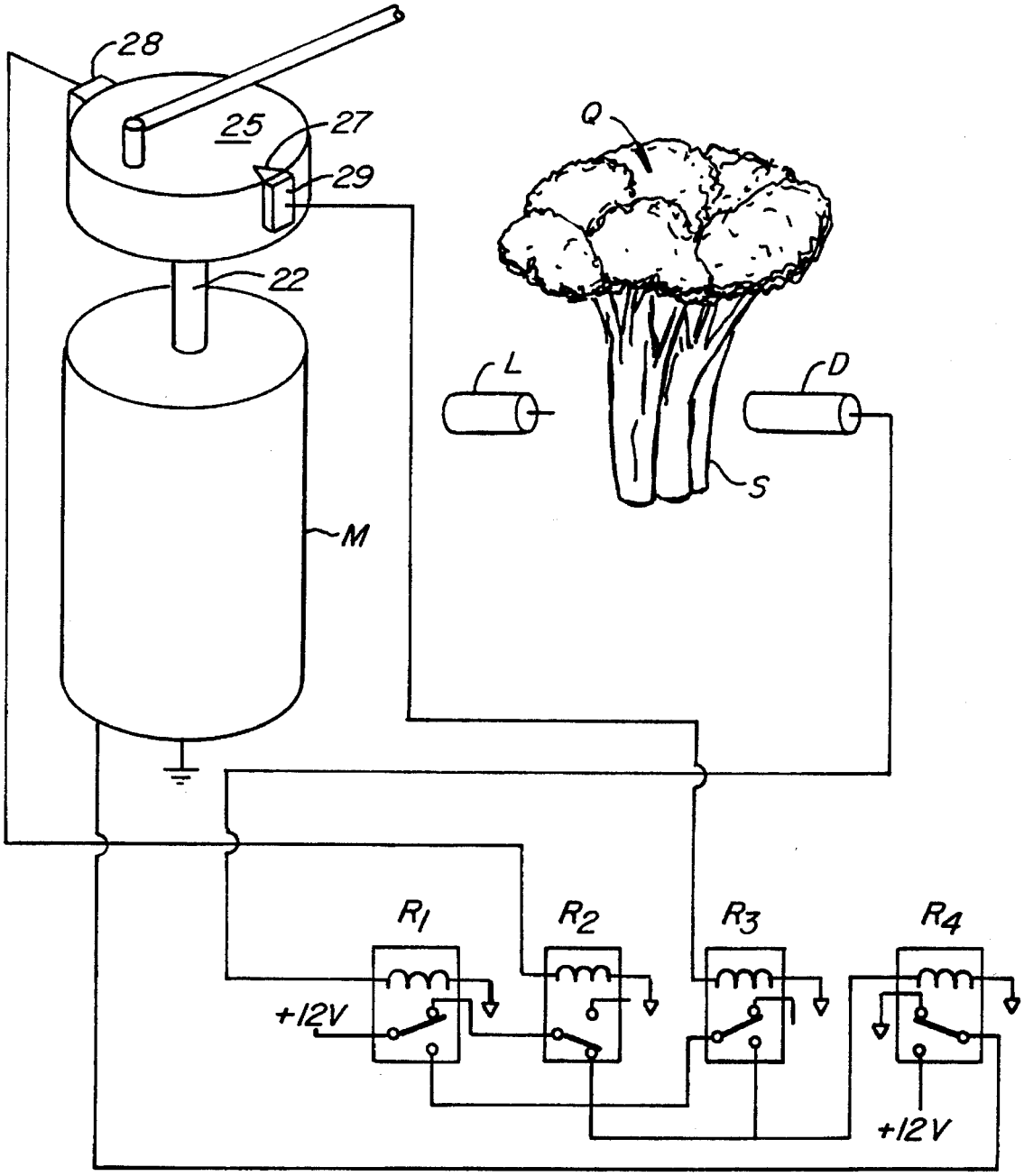
FIG. 4 is a schematic illustrating the motor drive, electronic beam, and connected relays for causing banding arm movement; and, FIG. 5 is a schematic of the connections of one of the arms to the rotating plates of the mechanism of FIG. 1 to illustrate the spring bias apparatus for allowing spring bias of the arms to the inner concentric position.

Referring to FIGS. 1 and 4, the actuation of pivotal arms $F_1$–$F_4$ to move responsive to insertion of bouquet of broccoli Q at stems S can readily be understood. Specifically, light source L projects light across central aperture A to detector D. Presuming that stems S have not been inserted centrally of central aperture A, relay R remains closed. Upon interruption of light source L, detector D operatively connected to relay R causes the relay to close, activating constant speed motor M. Constant speed motor M rotates motor output shaft 24 which is in turn connected to driving wheel 25.

Referring to FIG. 4, it is important to observe that driving wheel 25 is provided with rotation mark 27. Rotation mark 27 is in turn sensed by rotation mark sensors 28–29. These respective rotation mark sensors 28–29 cooperate with the circuitry of FIG. 4 to bring about the desired motion of pivotal arms $F_1$–$F_4$.

Regarding this cooperation, when driving wheel 25 is first actuated in movement by the closing of relay R, movement of driving wheel 25 continues until rotation mark 27 registers to rotation mark sensor 28. Thereafter, rotation mark sensor 28 senses rotation mark 27 and opens power to motor M through relay $R_3$ and $R_4$. Power to motor M is interrupted for a set time period and all motion ceases.

Light detector D contains a built in time delay. At the end of a preferred four second period, detector D closes relay $R_1$ and motion of driving wheel 25 resumes. Such motion continues until rotation mark 27 registers to rotation mark sensor 29. When such motion occurs, relay $R_2$ opens, rotation of motor M ceases and the machine is then ready for the next banding cycle.

It will be understood that when rotation mark 27 is located registered to rotation mark sensor 29, pivotal arms $F_1$–$F_4$ are away from central aperture A preferably with rubber band B in the stretched disposition. When rotation mark 27 is located registered to rotation mark sensor 28, pivotal arms $F_1$–$F_4$ are concentric to central aperture A for banding of stems S of bouquet of broccoli Q. The time delay presents a sufficient interval for removal of bouquet of broccoli Q and placement of rubber band B for the repeat of the disclosed cycle. Time delay is integral with detector D; when detector D senses light, delay occurs before a signal is transmitted.

It will be understood that constant speed motor M can be chosen to provide optimum movement of the disclosed apparatus. Further, the interval of time delay relay T can be adjusted—preferably to suit the speed of the particular worker involved. Likewise, adjustment of constant speed motor M can occur to stay within the elastic rate of expansion of rubber band B.

Understanding of the relays $R_1$–$R_4$ can be easily understood. Relay $R_4$ is normally grounded. In this disposition, it brakes motor M. When relay $R_4$ is on, it connects to a 12 volt power source and rotation of motor M occurs.

Relays $R_2$ and $R_3$ serve to stop motor rotation. Such stoppage occurs when rotation mark 27 registers to rotation mark sensors 28–29.

Finally, relay $R_1$ functions to begin rotation. When detector D has light from light source L interrupted by stalk S, rotation of motor M first occurs.

What is claimed is:

1. A broccoli banding machine comprising:

a plate with a central aperture;

a light sensor mounted adjacent said central aperture;

a light source for emanating a beam across the central aperture to said light sensor;

band engaging fingers attached to said plate and moveable between a first position juxtaposed to one another adjacent said central aperture to a second position wherein said fingers are separate from one another;

a motor drive for moving said band engaging fingers between said first and second positions;

means for actuating said motor drive responsive to interruption of said light beam to move said fingers from said second position wherein said fingers are away from said central aperture to said first position wherein said fingers are juxtaposed to one another at said central aperture;

time delay relay means for actuating said motor drive to move said fingers from said first position wherein said fingers are juxtaposed to one another at said central aperture to said second position where said fingers are away from said central aperture upon expiration of a time delay.

2. A broccoli banding machine according to claim 1 and wherein:

said motor drive is an electric motor drive.

3. A broccoli banding machine according to claim 1 and wherein:

said light source and light detector are immediately below said central aperture.

4. A broccoli banding machine according to claim 1 and wherein:

said band engaging fingers are spring biased toward said first position juxtaposed to one another at said central aperture.

5. A process including a broccoli banding machine for placing a rubber band about a bouquet of broccoli comprising the steps of:

providing a broccoli banding machine including:

a plate with a central aperture;

a light sensor mounted immediate said central aperture;

a light source for emanating a beam across the central aperture to said light sensor;

band engaging fingers attached to said plate and moveable between a first position juxtaposed one to another at said central aperture to a second position wherein said fingers are separate from one another; and, a motor drive for moving said band engaging fingers between said first and second position;

bunching a bouquet of broccoli with the stems of said bouquet held together;

interrupting said light beam with said bunched stems of broccoli;

actuating said motor drive responsive to interruption of said light beam to move said fingers from said second position wherein said fingers are away from said central aperture to said first position wherein said fingers are juxtaposed to one another at said central aperture to place a rubber band about said broccoli stems;

removing said broccoli bouquet with said rubber band on said stems;

placing a replacement rubber band on said fingers; and, actuating said motor drive after said rubber band is on said fingers to move said fingers from said first position wherein said fingers are juxtaposed to one another at said central aperture to said second position where said fingers are away from said central aperture to expand said rubber band upon expiration of a time delay.

6. A process including a broccoli banding machine for placing a rubber band about a bouquet of broccoli according to claim 5 comprising the steps of:

said provided motor drive is an electric motor drive.

7. A process including a broccoli banding machine for placing a rubber band about a bouquet of broccoli according to claim 5 comprising the steps of:

said provided light source and light detector are immediately below said central aperture.

8. A process including a broccoli banding machine for placing a rubber band about a bouquet of broccoli according to claim 5 comprising the steps of:

said provided band engaging fingers are spring biased toward said first position concentric to said central aperture.

* * * * *